United States Patent [19]

Larsson et al.

[11] 3,932,178

[45] Jan. 13, 1976

[54] METHOD OF ISOSTATIC HOT PRESSING OF POWDER

[75] Inventors: Hans Gunnar Larsson; Carl Bergman, both of Vasteras, Sweden

[73] Assignee: Allmanna Svenska Elektriska Aktiebolaget, Vasteras, Sweden

[22] Filed: Oct. 16, 1972

[21] Appl. No.: 297,648

[30] Foreign Application Priority Data

Oct. 14, 1971 Sweden ..... 13011/71

[52] U.S. Cl. ..... 75/226; 75/214

[51] Int. Cl.[2] ..... B22F 3/14

[58] Field of Search ..... 75/226, 214; 29/182

[56] References Cited

UNITED STATES PATENTS 3,562,371 2/1971 Bush ..... 75/226

3,599,281 8/1971 Boyer ..... 75/226

*Primary Examiner*—Benjamin R. Padgett

*Assistant Examiner*—B. H. Hunt

[57] ABSTRACT

In isostatic hot pressing of powder in a collapsible container, the powder is enclosed in a container which is provided with one or more evacuation openings, and a conical support is held in position adjacent the evacuation openings. A funnel-shaped body of sheet metal is secured above the support and the evacuation openings by welding its edge to the wall of the container. The body is evacuated through a suction tube connected to the funnel and the tube is sealed. Thereafter the container is subjected to heat and pressure, and the funnel-shaped member collapses into engagement with the conical support.

5 Claims, 8 Drawing Figures

METHOD OF ISOSTATIC HOT PRESSING OF POWDER

BACKGROUND OF THE INVENTION

1. Field of the Invention

The present invention relates to a method for manufacturing products by bonding together the powder in a shaped object to form a dense body by means of isostatic hot pressing of the powder under high pressure, (pressure sintering). During the sintering the powder billet is enclosed in a metal container which is placed in a pressure furnace and is subjected in this furnace simultaneously to a high, all-sided gas pressure and high temperature. As a rule, the object formed by the powder is degassed during the first part of the heating prior to the sintering by means of vacuum suction in the container, in order to remove gases which have combined with the powder or been bound to the surface of the powder grains. As a rule, this degassing takes place at very low pressure by connecting the container enclosing the powder body to a vacuum pump. The invention is of particular interest in the manufacture of billets, for example billets of material of high-speed steel type or so-called superalloys, said billets being further processed to the desired shape by rolling, forging or machining.

2. The Prior Art

Powder Metallurgy 1964 Vol. 7 No. 14, pages 168–201 , contains a detailed article on pressure sintering by E.S. Hodge, Interceram No. 4 1967 and Nos. 1,2, and 3 1978 contain a detailed description of Isostatic pressing by E.L.J. Papen. The invention can be applied in the method described in, for example, Lundstrom application Ser. No. 866,885, filed Oct. 16, 1969, of which a continuation-in-part application, Ser. No. 68,665 was filed on Sept. 1, 1970. The equipment described therein may be used.

The method according to the invention relates to a way of connecting a suction line to a metal container which encloses a powder body, and the design of the connection of an evacuation tube to the container.

Metal powder which is brought into contact with air absorb gases present in the air on its surface and forms compounds with these, especially oxides. These absorbed gases and oxides are removed to the greatest possible extent since the powder is degassed during the heating prior to the sintering. In the degassing of powder bodies which are enclosed in a metal container, the container, mostly a lid, has been provided with a welded-on tube which is connected to a vacuum pump during the degassing process. However, it has proved very difficult to arrange a large evacuation opening in the container which gives little resistance to evacuation of gases, and at the same time achieve a connection between the container and a welded-on tube which withstands the following isostatic pressure sintering. The weakest spot is the welded joint between the container and the tubular element, by means of which the container is connected to the vacuum pump. This welded joint has burst when affected by the gas pressure acting on the container during the sintering. The difficulties in achieving a solid welded joint have increased with the increased size of the evacuation opening and the resultant increased diameter of the connection tube welded round the opening.

SUMMARY OF THE INVENTION

By means of the invention, it has become possible to use a large evacuation opening which permits a quick evacuation and in spite of this achieves a connection to a vacuum line which withstands the pressure sintering, and this is an important condition for obtaining the intended bonding and density in the treated body.

According to the invention, a body of powder is enclosed within a collapsible chamber having an evacuation opening or openings. A conical outwardly extending support is held by the container in the area of the evacuation opening or openings. A funnel-shaped element of sheet metal having a tube attached thereto is applied over the opening or openings and its edge is welded to the wall of the container. The evacuation opening or openings are thus left substantially unobstructed. A tube is welded to the funnel-shaped element and connected to vacuum so that the powder is degassed. Thereafter the tube is sealed, thereby also sealing the funnel-shaped member, and the container is subjected to isostatic pressure while being heated. The pressure is sufficient to collapse the funnel-shaped member against the support.

BRIEF DESCRIPTION OF THE DRAWINGS

The invention will be further described with reference to the accompanying drawings which show a cylindrical body of powder, for example a billet for further machining to the desired shape by means or rolling or forging, said body being enclosed in a metal container.

DESCRIPTION OF THE PREFERRED EMBODIMENTS

Figure 1:
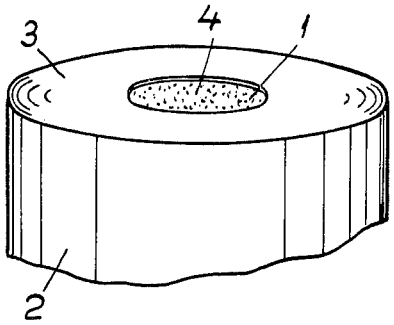
FIGS. 1–5 show perspective sketches of the metal container with a connection tube for the vacuum pump and enclosed powder body of powder billet at different times of a work cycle.
Figure 2:
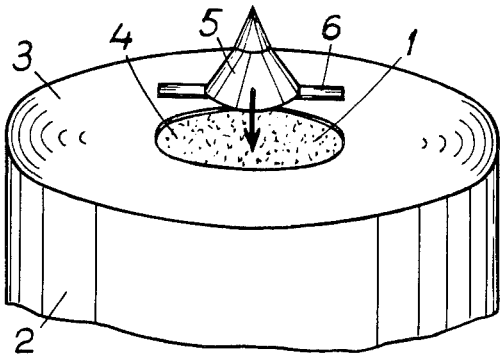
Figure 3:
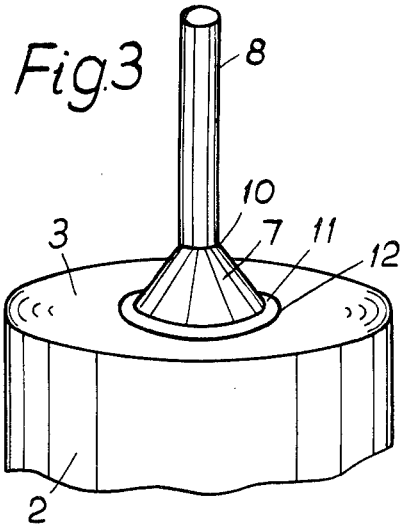
Figure 4:
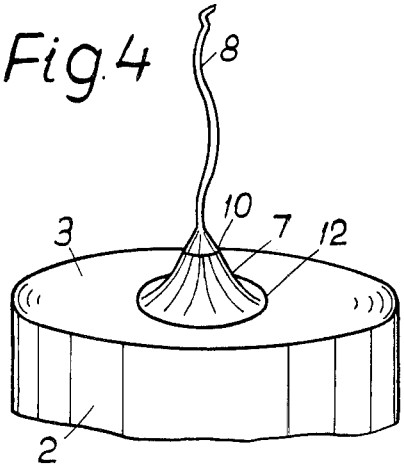
Figure 7:
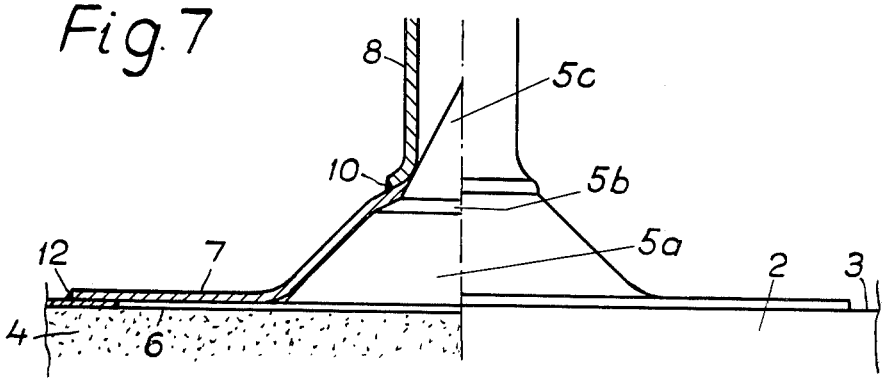
Figure 8:
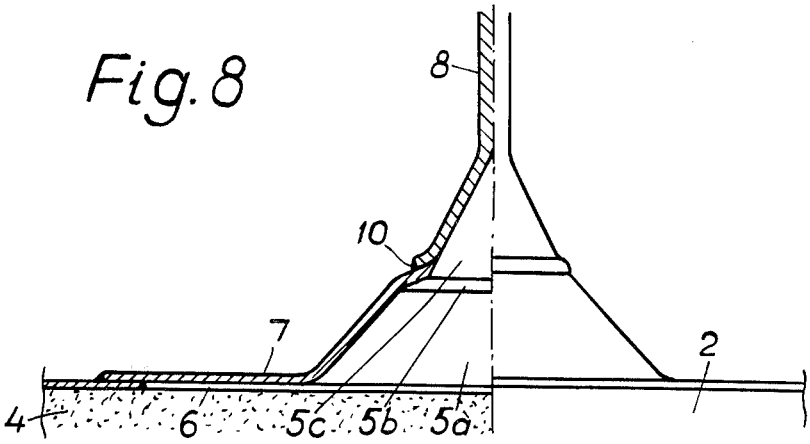

FIG. 1 shows a powder billet which is enclosed in a collapsible container having an exposed evacuation opening 1 in the lid 3 of the container 2, or an evacuation opening made in said lid. In the opening 1, the end surface of the powder billet 4 is visible. The powder billet may be packed to high density in connection with the filling or, besides this, be further compressed by means of isostatic cold pressing in a pressure chamber while being exposed to a liquid or gas with high pressure. In the evacuation opening 1 a conical support element 5 is placed on the powder billet 4. The support element can be fixed in the middle of the opening 1 by means of holders 6, as shown in FIG. 2. Over the opening 1 a funnel-shaped element is placed, this being constituted by a sheet metal cone 7. A tube 8 is welded to said sheet metal cone, said tube being intended for connection to a vacuum line during the degassing period. The cone 7 and the tube 8 are joined by means of a weld 10. The cone at its larger end is provided with a flange 11. This is connected to the lid 3 by means of a weld 12. The appearance after the attachment of the funnel-shaped connection element is clear from FIGS. 3 and 6. FIGS. 4 and 8 show the appearance of the funnel-shaped element after the pressure sintering. FIG. 7 shows the funnel-shaped element when the cone 7 has collapsed under an external gas pressure, but before this pressure has been able to compress the tube 8.

Figure 5:
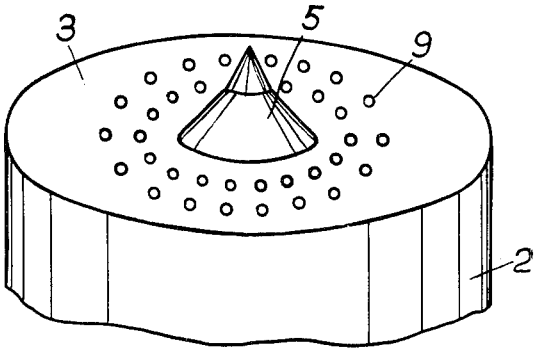

In the alternative embodiment shown in FIG. 5, there are a number of openings 9 in the container within an annular area on the lid 3. The cone 5 is placed in the middle of the group of holes. If the powder is only mechanically packed in connection with the filling, the powder body has low firmness. In order to prevent loose powder from running out through the opening or openings in the handling of the container filled with powder or during the vacuum suction, a mat of steel whool having suitable, generally low, carbon content can be positioned between the lid 3 and the end surface of the powder billet 4.

Figure 6:
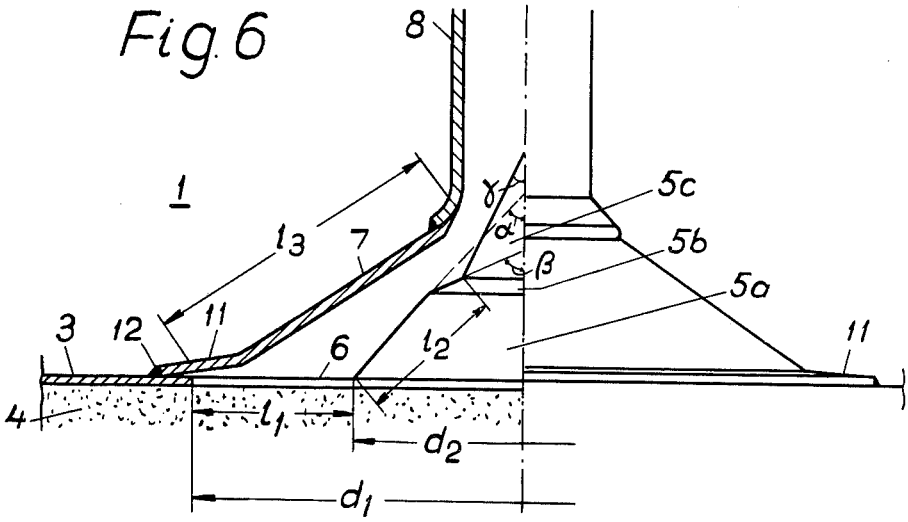
FIGS. 6–8 show sections and views of the invention more in detail.

As is shown in FIG. 6, the conical support element 5 has three different angles of conicity. The acute angle $2\beta$ of the central part 5 *b* is larger than the acute angles $2\alpha$ and $2\gamma$ of the lower and upper parts. The angles $\alpha$ and $\gamma$ may be equally large. The acute angle of the sheet metal cone 7 is preferably as large as the acute angle of the part 5 *b*, that is $2\beta$. The diameter of the evacuation opening is $d_1$ and the bottom diameter of the support element 5 is $d_2$. Between the lid 3 and the support element 5 an annular surface is thus formed having a width $l_1$, where gases may escape unimpededly. In addition to this, it is possible to place the support element 5 somewhat above the upper surface of the powder body so that gases may freely escape also below the support element. A mat of steel wool may be used. Because of the large, free surface of the powder body, the escape of gases during the degassing is made easier, making it possible to obtain efficient degassing in a short time.

The relative strength of the tube 8 and the cone 7 is preferably chosen so that the cone 7 when the pressure increases in the pressure furnace is first pressed downwards against the central part 5 *b* of the support element 5 and then downwards against the powder billet 4 in the annular space between the lid 3 and the lower part 5 *a* of the support element 5. After this is done, the tube 8 is compressed as shown in FIG. 7. In the embodiment according to FIG. 6, the sum of the distance $l_1$ and $l_2$ is somewhat larger than $l_3$. If the difference between $l_1 + l_2$ and $l_3$ is chosen to be approximately equal to the decrease in diameter of the powder billet and the container, this results in insignificant extension of the cone material during the pressing. In this way, the strain in the welds 10 and 12 is moderate when the cone is pressed down. After the cone 7 has been pressed down, the tube 8 is compressed, as shown in FIG. 7. Because of the support from the conical part 5 *c*, the weld 10 is exposed only to insignificant strain.

We claim:

1. Method of isostatic hot pressing of powder which comprises enclosing a body of powder within a collapsible container having at least one evacuation opening, arranging an outwardly extending support within the area of the evacuation opening and held by the container, applying a funnel-shaped member having a tube attached thereto above the opening and securing the outer edge of said funnel-shaped member of the container, said funnel-shaped member when so applied leaving the evacuation opening substantially unobstructed, applying suction to said tube to evacuate gases from the powder, sealing the funnel-shaped member, and subjecting the evacuated container to heat and pressure, the pressure being sufficient to collapse the funnel-shaped member against the support.

2. A method as claimed in claim 1, in which said container has a single evacuation opening and the support is mounted above the evacuation opening.

3. Method as claimed in claim 1, in which said container has a plurality of evacuation openings with a wall portion therewithin and said support is mounted on such wall portion.

4. Method as claimed in claim 1, which includes the steps of pouring powder into said container, isostatically compacting the powder, and then forming said evacuation opening in the container.

5. Method as claimed in claim 1, which includes the step of applying a layer of steel wool between the part of the container containing the opening and the powder in the container.

* * * * *